US011149755B2

(12) United States Patent
Hand et al.

(10) Patent No.: US 11,149,755 B2
(45) Date of Patent: Oct. 19, 2021

(54) HYDRAULIC SYSTEM FOR A WORK MACHINE HAVING A HYDRAULIC WINCH

(71) Applicant: Caterpillar Inc., Peoria, IL (US)

(72) Inventors: Timothy L. Hand, Metamora, IL (US); Christopher M. Gruel, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/654,313

(22) Filed: Oct. 16, 2019

(65) Prior Publication Data

US 2021/0115949 A1 Apr. 22, 2021

(51) Int. Cl.

*F15B 21/0423* (2019.01)
*F15B 9/08* (2006.01)
*B66D 5/26* (2006.01)

(52) U.S. Cl.

CPC ..... *F15B 9/08* (2013.01); *B66D 5/26* (2013.01); *F15B 21/0423* (2019.01); *B66D 2700/0183* (2013.01); *F15B 2211/3056* (2013.01)

(58) Field of Classification Search

CPC . B66D 2700/0183; B66D 1/44; E02F 9/2016; F15B 21/042; F15B 21/0423; F15B 2211/611; F15B 2211/62

See application file for complete search history.

(56) References Cited

U.S. PATENT DOCUMENTS 3,768,263 A * 10/1973 Olson ..... F16H 61/4043 60/425
3,893,572 A * 7/1975 Axelsson ..... B66D 1/08 212/258
3,895,564 A * 7/1975 Pinson ..... B66D 1/44 91/418
4,232,792 A * 11/1980 Shields ..... B66C 13/14 212/195
4,610,139 A * 9/1986 Skelly ..... B66D 1/44 60/327
2003/0182938 A1* 10/2003 Smith ..... F15B 11/162 60/422
2013/0276439 A1* 10/2013 Edmonson ..... F15B 21/005 60/327

(Continued)

FOREIGN PATENT DOCUMENTS

CN 2307731 Y 2/1999
CN 102011769 A * 4/2011 ..... F15B 21/04

(Continued)

*Primary Examiner* — F Daniel Lopez
*Assistant Examiner* — Matthew Wiblin

(57) ABSTRACT

A hydraulic system for powering a winch assembly of a work machine includes a hydraulic reservoir, a pump, a cooling system, a first path of travel, and a second path of travel. The first path of travel is disposed between the pump and the cooling system, and the winch assembly is powered by the hydraulic fluid moving along the first path of travel. The second path of travel is disposed between the pump and the cooling system. When the winch assembly is in an active condition, a first valve is in an open position such that the hydraulic fluid moves along the first path of travel and through the cooling system. When the winch assembly is in an idle condition, a second valve is in an open position such that the hydraulic fluid moves along the second path of travel and through the cooling system.

18 Claims, 5 Drawing Sheets

(56) References Cited

U.S. PATENT DOCUMENTS

| | | | | |
|---|---|---|---|---|
| 2018/0170569 | A1* | 6/2018 | Brodeur | B64D 33/08 |
| 2019/0338793 | A1* | 11/2019 | Uhlman | F15B 21/042 |

FOREIGN PATENT DOCUMENTS

| | | | | | |
|---|---|---|---|---|---|
| CN | 104743461 | A | | 7/2015 | |
| CN | 107200284 | A | * | 9/2017 | B66D 1/44 |
| CN | 207582539 | U | | 7/2018 | |
| DE | 102008027474 | A1 | * | 12/2009 | B61F 5/24 |
| DE | 102016107187 | A1 | * | 10/2017 | F15B 21/087 |
| FR | 1273119 | A | * | 10/1961 | B66D 1/08 |
| JP | 2004224509 | A | | 8/2004 | |
| JP | 5883749 | B2 | | 3/2016 | |

* cited by examiner

HYDRAULIC SYSTEM FOR A WORK MACHINE HAVING A HYDRAULIC WINCH

TECHNICAL FIELD

The present disclosure relates generally to work machines used in construction applications and, in particular, to hydraulic systems for work machines that have a hydraulic winch.

BACKGROUND

Work machines (e.g., a track-type tractor) used in construction settings typically include one or more work implements (e.g., a blade, a winch, a ripper, etc.). These work implements can be operatively connected to a hydraulic system such that hydraulic fluid can be used to power the work implements.

A ripper of a work machine is able to be lifted and tilted. Hydraulic systems for these work machines typically include a first flow path for hydraulic fluid that is used to power the lift function of the ripper and a second flow path for hydraulic fluid that is used to power the tilt function of the ripper. A ripper can be removed from these work machines and replaced with a winch. The winch only requires the use of one of the flow paths of the hydraulic system, which means that the other flow path is not used when a ripper is replaced with a winch.

Hydraulic systems for work machines that include a hydraulic winch can overheat quickly. For example, after hydraulic fluid powers the winch, the hydraulic fluid returns to a hydraulic reservoir, and this return hydraulic fluid is typically the hottest hydraulic fluid in the system. The return hydraulic fluid can cause the hydraulic system to overheat, and/or cause a delay in the amount of time it takes for the hydraulic system to recover after overheating.

A cooling system has been placed in hydraulic systems such that return hydraulic fluid from a winch moves through the cooling system prior to returning to a hydraulic reservoir. The cooling system delays the overheating of the hydraulic system by causing the temperature of the hydraulic fluid to decrease prior to returning to the hydraulic reservoir.

SUMMARY

An exemplary embodiment of a hydraulic system for powering a winch assembly of a work machine includes a hydraulic reservoir, a pump, a cooling system, a first path of travel, a first valve, a second path of travel, and a second valve. The pump is configured to pump hydraulic fluid from the hydraulic reservoir and move the hydraulic fluid along the first path of travel and the second path of travel. The first path of travel is disposed between the pump and the cooling system, and the winch assembly is powered by the hydraulic fluid moving along the first path of travel. The first valve is in fluid communication with the pump and disposed along the first path of travel, and the first valve is movable between an open position and a closed position. The second path of travel is disposed between the pump and the cooling system. The second valve is in fluid communication with the pump and disposed along the second path of travel, and the second valve is movable between an open position and a closed position. The cooling system is configured to decrease a temperature of the hydraulic fluid as the hydraulic fluid moves through the cooling system. When the winch assembly is in an active condition, the first valve is in the open position and the second valve is in the closed position, such that the hydraulic fluid moves along the first path of travel and through the cooling system. When the winch assembly is in an idle condition, the first valve is in the closed position and the second valve is in the open position, such that the hydraulic fluid moves along the second path of travel.

An exemplary embodiment of a work machine includes a frame, a ground-engaging mechanism, a drivetrain for driving the ground engaging mechanism, a winch assembly, and a hydraulic system. The winch assembly is movable between an active condition and an idle condition. The hydraulic system is configured to power the winch assembly when the winch assembly is in the active condition. The hydraulic system includes a hydraulic reservoir, a pump, a cooling system, a first path of travel, a first valve, a second path of travel, and a second valve. The pump is configured to pump hydraulic fluid from the hydraulic reservoir and move the hydraulic fluid along the first path of travel and the second path of travel. The first path of travel is disposed between the pump and the cooling system, and the winch assembly is powered by the hydraulic fluid moving along the first path of travel. The first valve is in fluid communication with the pump and disposed along the first path of travel, and the first valve is movable between an open position and a closed position. The second path of travel is disposed between the pump and the cooling system. The second valve is in fluid communication with the pump and disposed along the second path of travel, and the second valve is movable between an open position and a closed position. The cooling system is configured to decrease a temperature of the hydraulic fluid as the hydraulic fluid moves through the cooling system. When the winch assembly is in the active condition, the first valve is in the open position and the second valve is in the closed position, such that the hydraulic fluid moves along the first path of travel and through the cooling system. When the winch assembly is in the idle condition, the first valve is in the closed position and the second valve is in the open position, such that the hydraulic fluid moves along the second path of travel.

An exemplary method of cooling hydraulic fluid of a hydraulic system for a winch assembly of a work machine includes moving the hydraulic fluid from a hydraulic reservoir along a first path of travel when the winch assembly is in an active condition such that the hydraulic fluid moves through the winch assembly, through a cooling system, and returns to the hydraulic reservoir. The method further includes moving the hydraulic fluid from the hydraulic reservoir along a second path of travel when the winch assembly is in an idle condition such that the hydraulic fluid moves through the cooling system and returns to the hydraulic reservoir.

DETAILED DESCRIPTION

While the present disclosure describes certain embodiments of hydraulic systems for work machines that have a hydraulic winch, the present disclosure is to be considered exemplary and is not intended to be limited to the disclosed embodiments. Also, certain elements or features of embodiments disclosed herein are not limited to a particular embodiment, but instead apply to all embodiments of the present disclosure.

The present application discloses a hydraulic system for a work machine that includes a hydraulic winch, in which the hydraulic system is configured to prevent overheating of the hydraulic system, as well as reduce the recovery time of a hydraulic system that has overheated. The hydraulic system includes a first path of travel for cooling hydraulic fluid that has passed through a winch assembly of the work machine, and a second path of travel for cooling hydraulic fluid that is being stored within a hydraulic reservoir. Both the first and second paths of travel lead to a cooling system that cools the hydraulic fluid before the hydraulic fluid returns to the hydraulic reservoir. When the winch assembly is active, hydraulic fluid of the hydraulic system is moved along the first path of travel, such that the hydraulic fluid moves through the winch assembly and the cooling system prior to returning to the hydraulic reservoir. When the winch assembly is idle, hydraulic fluid is moved along the second path of travel, such that the hydraulic fluid moves through the cooling system and then returns to the hydraulic reservoir.

Figure 1:
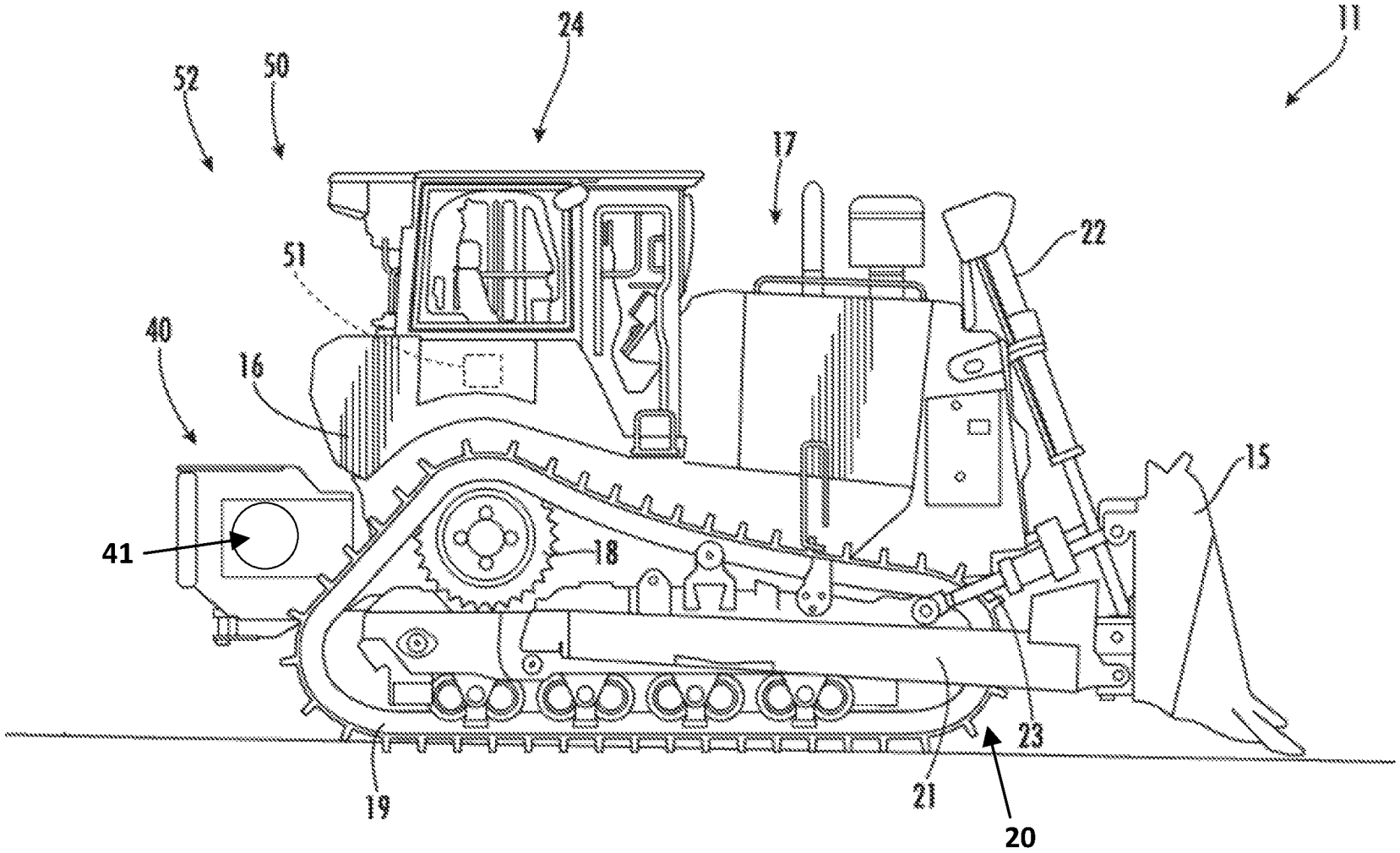
FIG. 1 is a side view of an exemplary embodiment of a work machine.

FIG. 1 illustrates an exemplary embodiment of a work machine 11 that includes a hydraulically driven winch assembly 40. The work machine 11 can be, for example, a track-type tractor or any other type of work machine that includes a winch assembly. The winch assembly 40 includes a winch spool 41 and a winch cable (not shown), in which the winch cable is operatively connected to the winch spool 41 such that rotation of the winch spool 41 causes the winch cable to be reeled in around the winch spool 41 or reeled out off of the winch spool 41. The winch assembly 40 is operatively connected to a hydraulic system (e.g., hydraulic system 200 shown in FIG. 2 or hydraulic system 300 shown in FIGS. 3-5) that is configured to provide power to the winch assembly to rotate the winch spool.

The work machine 11 may include a frame 16, a work implement 15, an engine 17, a ground-engaging mechanism 19, and a drivetrain 20. In the illustrated embodiment, the ground-engaging drive mechanism 19 is a track that is operatively connected to a sprocket 18. In other embodiments, however, the ground-engaging drive mechanism 19 may be wheels or any other type of ground-engaging drive mechanism. The drivetrain 20 is operatively connected to the engine 17 to drive the sprockets 18 and the tracks 19. The systems and methods of the disclosure may be used with any type of machine propulsion and drivetrain mechanisms applicable in the art for causing movement of the work machine 11, such as, for example, hydrostatic drives, electric drives, or mechanical drives.

In the illustrated embodiment, the work machine 11 is a blade configured to push material. In other embodiments, however, the work implement 15 can take the form of any other type of work implement for a work machine. The blade 15 may be pivotally connected to the frame 16 by arms 21 on each side of the work machine 11. In some embodiments, a first hydraulic cylinder 22 is coupled to the frame 16 and supports the blade 15 in a vertical direction. The first hydraulic cylinder 22 is configured to move the blade 15 up or down vertically. A second hydraulic cylinder 23 may be coupled to the frame 16 on each side of the work machine 11 and configured to adjust the tilt angle and/or pitch angle of the blade 15.

The work machine 11 may include a cab 24 that an operator may physically occupy and provide input to the control the work machine. The cab 24 may include one or more input devices (e.g., a joystick or any other suitable input device) through which the operator may issue operating commands to control the propulsion system and steering system of the work machine 11, as well as operate the work implement 15, winch assembly 40, or any other implement of the work machine 11. In some embodiments, the operator can operate the machine 11 from a remote location.

The operation of the engine 17, the drivetrain 20, the winch assembly 40, the hydraulic systems, and other systems and components of the work machine 11 may be controlled by a control system 50. The control system 50 may include a winch control system 52 that is configured to control the winch assembly 40. The control system 50 may include an electronic control module or controller 51 and a plurality of sensors. The controller 51 may receive input signals from an operator that is operating the work machine 11 from within the cab 24 or off-board the work machine 11 through a wireless communications system.

The controller 51 may be an electronic controller that operates in a logical fashion to perform operations, execute control algorithms, store and retrieve data and other desired operations. The controller 51 may include or access memory, secondary storage devices, processors, and any other components for running an application. The memory and secondary storage devices may be in the form of read-only memory (ROM) or random access memory (RAM) or integrated circuitry that is accessible by the controller 51. Various other circuits may be associated with the controller 51 such as power supply circuitry, signal conditioning circuitry, driver circuitry, and other types of circuitry.

The control system 50 may be a single controller or may include more than one controller disposed to control various functions and/or features of the work machine 11. The term "controller" is meant to be used in its broadest sense to include one or more controllers and/or microprocessors that may be associated with the work machine 11 and that may cooperate in controlling various functions and operations of the machine. The functionality of the controller 51 may be implemented in hardware and/or software without regard to the functionality. The controller 51 may rely on one or more data maps relating to the operating conditions and the operating environment of the work machine 11 and an associated work site that may be stored in the memory of the controller 51. Each of these data maps may include a collection of data in the form of tables, graphs, and/or equations.

The control system 50 and the controller 51 may be located on the work machine 11 and may include components located remotely from the work machine 11. The functionality of the control system 50 may be distributed so that certain functions are performed at the work machine 11 and other functions are performed remotely.

Figure 2:
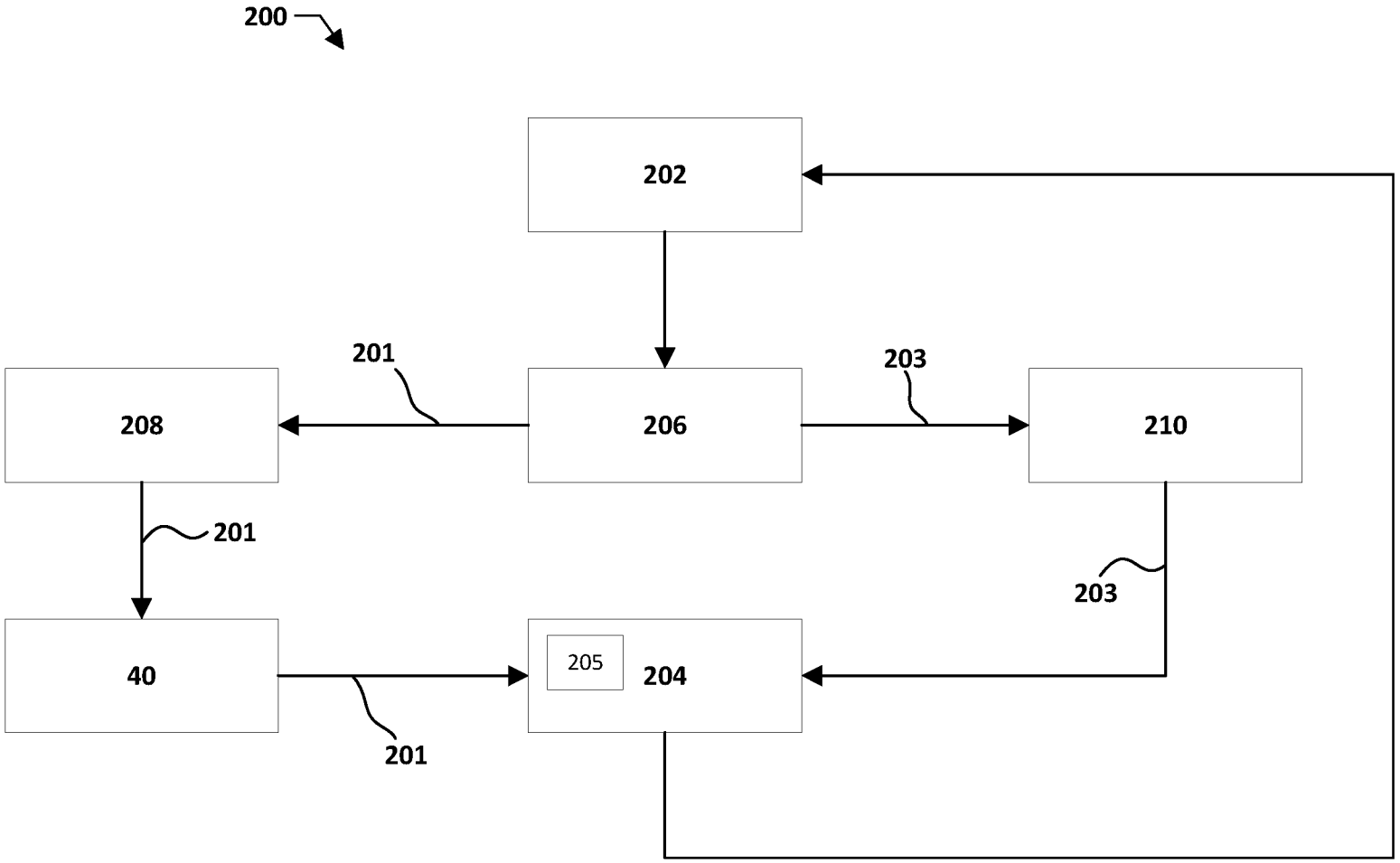
FIG. 2 is a flow chart of an exemplary embodiment of a hydraulic system for a work machine.

FIG. 2 illustrates an exemplary embodiment of a hydraulic system 200 for the work machine 11 of FIG. 1. The hydraulic system 200 shown in FIG. 2 may only include the portion of the hydraulic system that relates to the winch assembly 40 and a cooling system 204 for cooling the hydraulic fluid. It should be understood, however, that the hydraulic system 200 can include other components (e.g., pumps, valves, work implements, cooling systems, etc.), and the cooling system 204 can be used to cool hydraulic fluid associated with other components. In the illustrated embodiment, the cooling system 204 includes a radiator and fan assembly 205. The cooling system 204 can, however, take any suitable form, such as, for example, an oil-to-air heat exchanger, an oil-to-water heat exchanger, or any other suitable type of heat exchanger.

In the illustrated embodiment, the hydraulic system 200 includes a hydraulic reservoir 202 for holding hydraulic fluid. The hydraulic fluid can be, for example, oil or any other suitable fluid substance. A pump 206 is in fluid communication with the reservoir 202 such that the pump can move the hydraulic fluid from the reservoir 202 to one or more components of the work machine 11. In the illustrated embodiment, the pump 206 causes the fluid to be moved to a first valve 208 and/or a second valve 210. The first valve 208 is in fluid communication with the winch assembly 40 such that, when the first valve 208 is in an open position, the hydraulic fluid moves to the winch assembly 40 to cause the winch assembly to operate. The first valve 208 can be, for example, a directional control valve, a flow control valve, a pressure control valve, etc. The winch assembly 40 is in fluid communication with the cooling system 204 such that the hydraulic fluid used by the winch assembly moves through the cooling system 204 prior to returning to the hydraulic reservoir 202. The second valve 210 is in fluid communication with the cooling system 204 such that, when the second valve 210 is in an open position, the hydraulic fluid moves through the cooling system 204 and then returns to the reservoir 202. The second valve 210 can be, for example, a directional control valve, a flow control valve, a pressure control valve, etc.

In certain embodiments, the hydraulic system 200 is movable between a first mode in which the winch assembly 40 is active and a second mode in which the winch assembly 40 is idle. The hydraulic system may be moved between the first mode and the second mode by a control system (e.g., the control system 50 described in FIG. 1). When the hydraulic system is in the first mode, the hydraulic fluid is pumped from the hydraulic reservoir 202 such that the hydraulic fluid moves along a first path of travel 201 to the cooling system 204. In the illustrated embodiment, the first valve 208 is in an open position and the hydraulic fluid is pumped through the first valve 208 and into the winch assembly 40 to power the winch assembly 40. The temperature of the hydraulic fluid increases as the hydraulic fluid powers the winch assembly 40.

The heated hydraulic fluid then moves through the cooling system 204 to decrease the temperature of the hydraulic fluid prior to returning to the hydraulic reservoir 202, which works to prevent the hydraulic system 200 from overheating. When the hydraulic system 200 is in the first mode, the second valve 210 may be closed such that the hydraulic fluid is prevented from moving along a second path of travel 203 to the cooling system 204.

When the hydraulic system 200 is in the second mode, the hydraulic fluid is pumped from the hydraulic reservoir 202 such that the hydraulic fluid moves along a second path of travel 203 to the cooling system 204. In the illustrated embodiment, the second valve 210 is in an open position and the hydraulic fluid is pumped through the second valve 210 and the cooling system 204 prior to returning back to the hydraulic reservoir 202. The cooling system 204 is configured to decrease the temperature of the hydraulic fluid, which works to prevent the hydraulic system 200 from overheating, as well as helps an overheated hydraulic system to recover to a non-overheated condition. When the hydraulic system 200 is in the second mode, the first valve 208 may be closed such that the hydraulic fluid is prevented from moving along the first path of travel 201 to the winch assembly 40.

Figure 3:
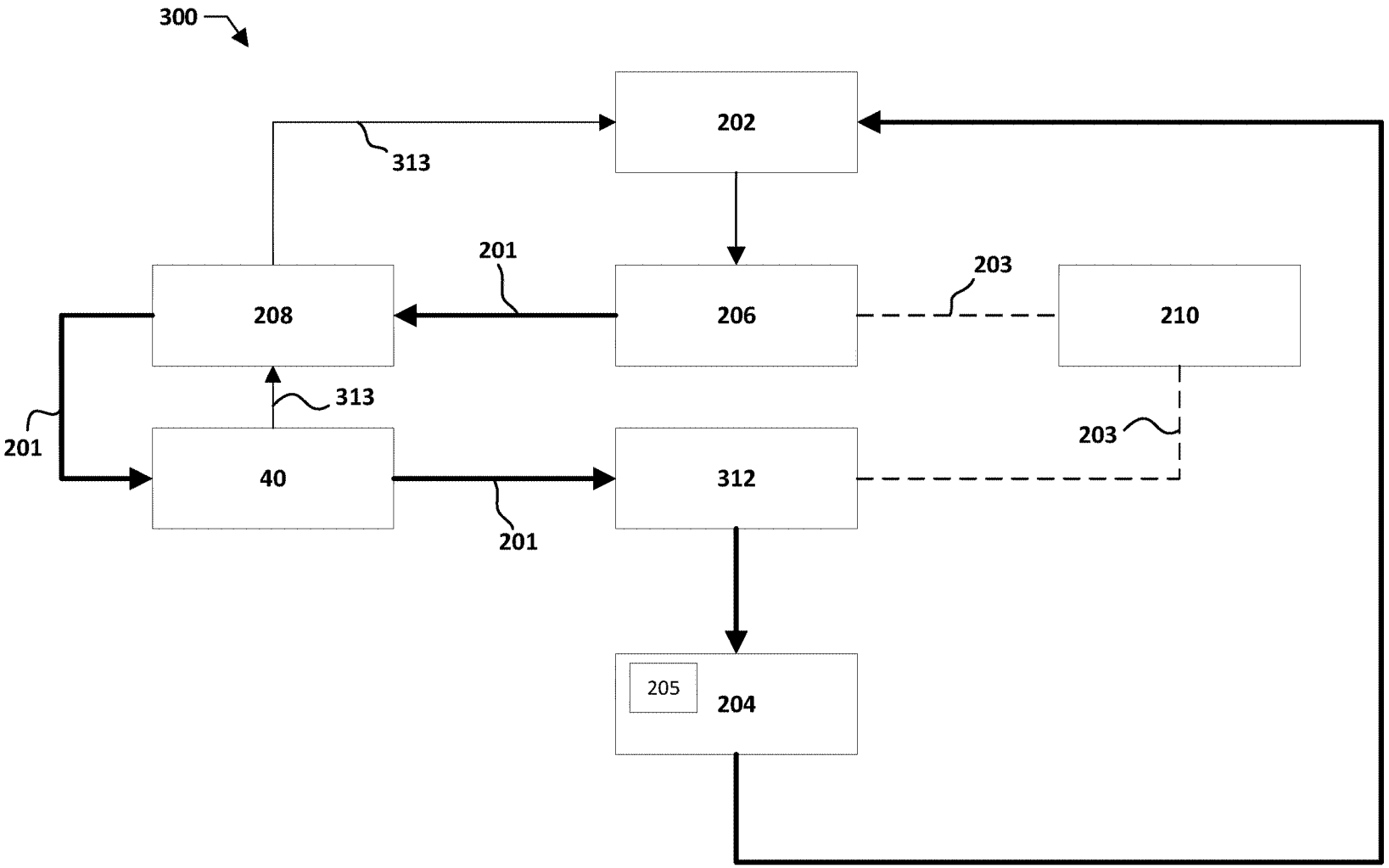
FIG. 3 is a flow chart of another exemplary embodiment of a hydraulic system for a work machine, in which the hydraulic system is in a first mode.
Figure 4:
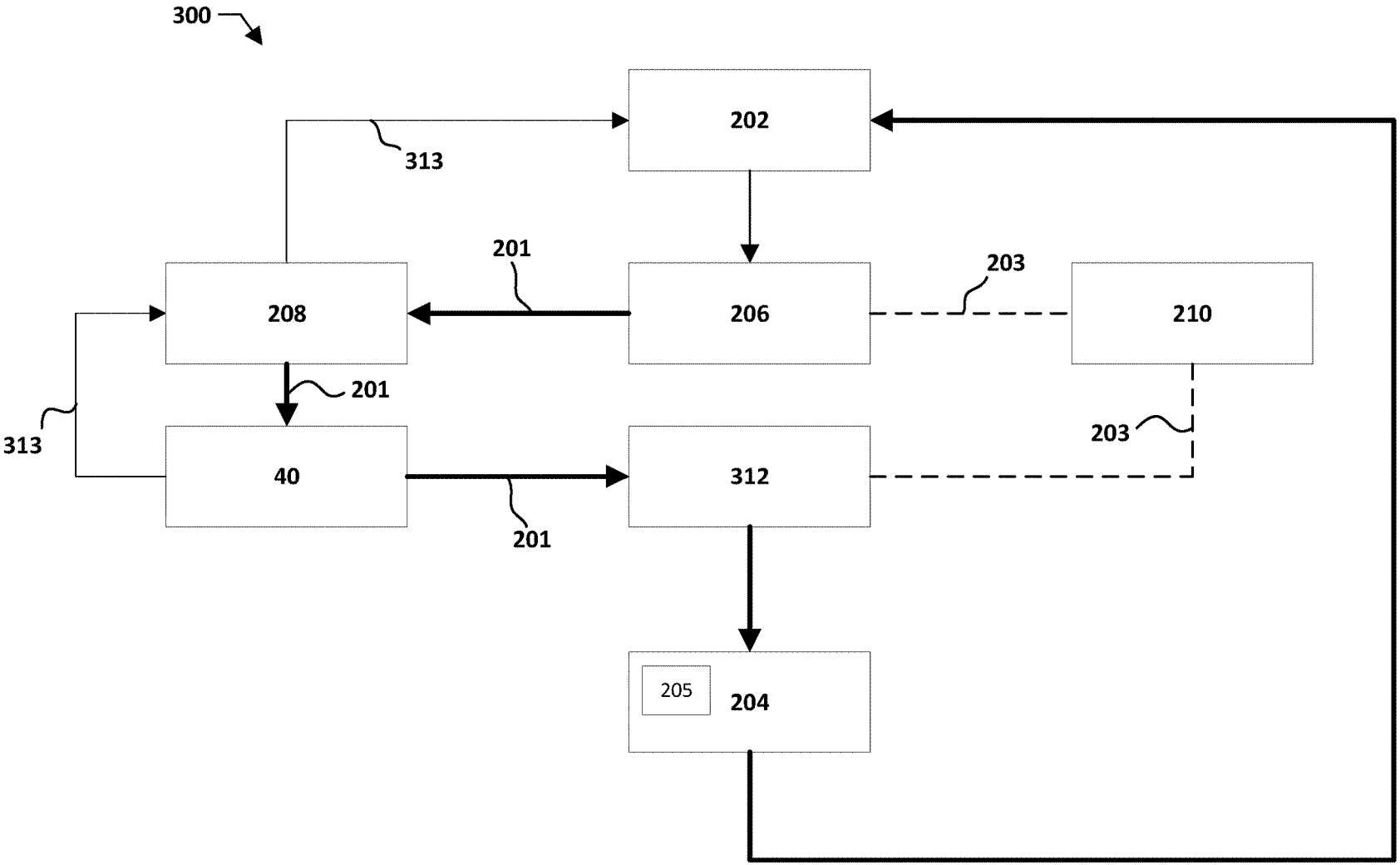
FIG. 4 is a flow chart of the hydraulic system of FIG. 3 in which the hydraulic system is in a second mode.
Figure 5:
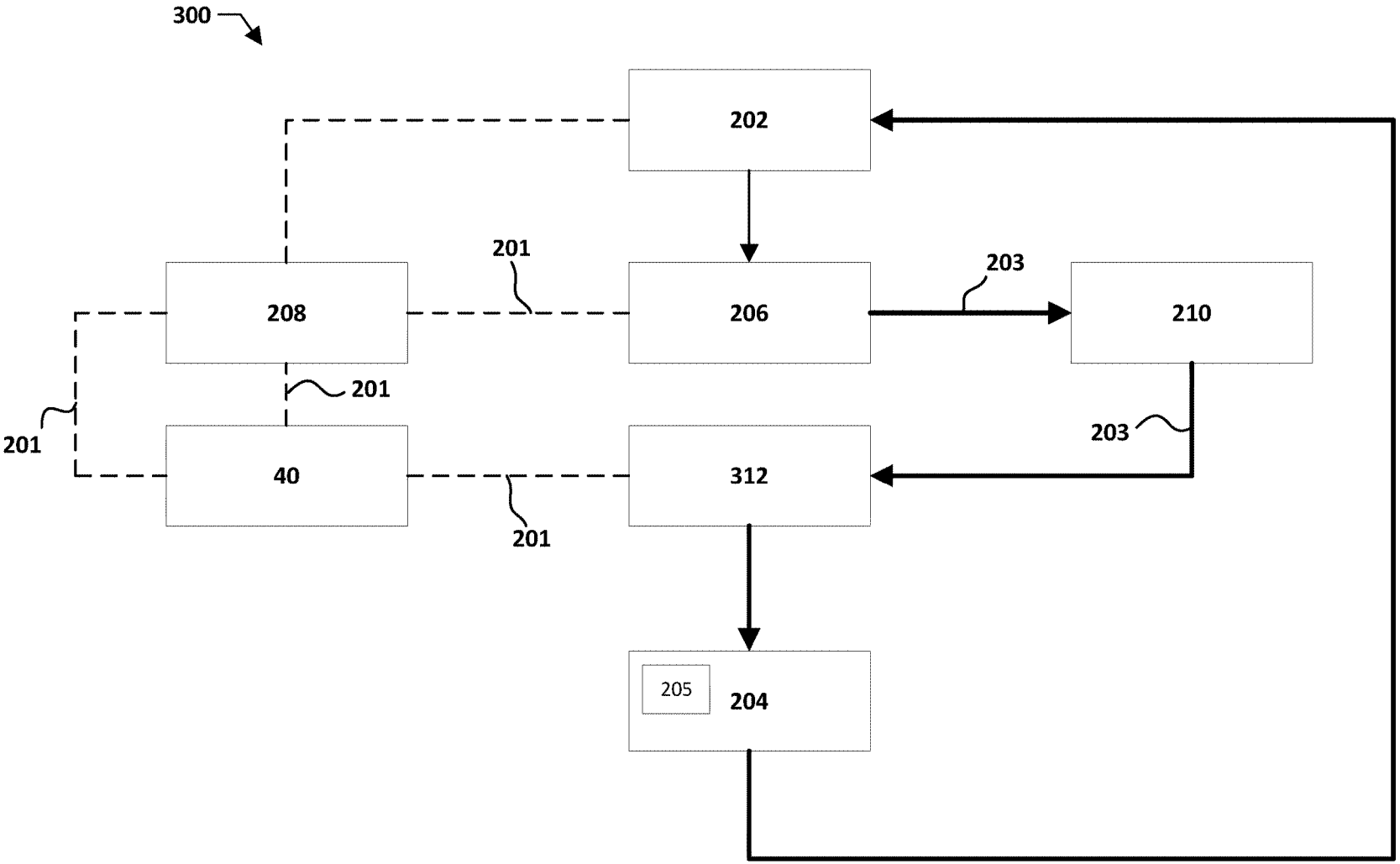
FIG. 5 is a flow chart of the hydraulic system of FIG. 3 in which the hydraulic system is in a third mode.

FIGS. 3-5 illustrate another exemplary embodiment of a hydraulic system 300 for the work machine 11 of FIG. 1. The hydraulic system 300 shown in FIGS. 3-5 is a more specific embodiment of the hydraulic system 200 shown in FIG. 2. The hydraulic system 300 may only include the portion of the hydraulic system that relates to the winch assembly 40 and a cooling system 204 for cooling the hydraulic fluid. It should be understood, however, that the hydraulic system 300 can include other components (e.g., pumps, valves, work implements, cooling systems, etc.), and the cooling system 204 can be used to cool hydraulic fluid associated with other components. In the illustrated embodiment, the cooling system 204 includes a radiator and fan assembly 205. The cooling system 204 can, however, take any suitable form, such as, for example, an oil-to-air heat exchanger, an oil-to-water heat exchanger, or any other suitable type of heat exchanger.

In the illustrated embodiment, the hydraulic system 300 includes a hydraulic reservoir 202 for holding hydraulic fluid. The hydraulic fluid can be, for example, oil or any other suitable fluid substance. A pump 206 is in fluid communication with the reservoir 202 such that the pump can move the hydraulic fluid from the reservoir 202 to one or more components of the work machine 11. In the illustrated embodiment, the pump 206 causes the fluid to be moved to a first valve 208 and/or a second valve 210. The first valve 208 is in fluid communication with the winch assembly 40 such that, when the first valve 208 is in an open position, the hydraulic fluid moves to the winch assembly 40 to cause the winch assembly to operate. After the hydraulic fluid moves through the winch assembly, at least a portion of the hydraulic fluid may move back through the first valve 208 and into the hydraulic reservoir 202 without moving to the cooling system 204. The first valve 208 can be, for example, a directional control valve, a flow control valve, a pressure control valve, etc. The winch assembly 40 is in fluid communication with the cooling system 204 such that the hydraulic fluid used by the winch assembly may move through the cooling system 204 prior to returning to the hydraulic reservoir 202. The second valve 210 is in fluid communication with the cooling system 204 such that, when the second valve 210 is an open position, the hydraulic fluid moves through the cooling system 204 and then returns to the reservoir 202. The second valve 210 can be, for example, a directional control valve, a flow control valve, a pressure control valve, etc.

In some embodiments, the hydraulic system 300 may include one or more pressure control valves 312 that are in fluid communication with the winch assembly 40 and the second valve 210 such that the hydraulic fluid moving from either the winch assembly 40 and/or the second valve 210 moves through the pressure control valves 312 prior to moving through the cooling system 204. The pressure control valves 312 are configured to prevent the pressure of the hydraulic fluid within the cooling system 204 from exceeding a predetermined amount. The pressure control valves 312 can be, for example, relief valves, sequence valves, priority valves, etc.

In certain embodiments, the hydraulic system 300 is movable between a first mode (shown in FIG. 3), a second mode (shown in FIG. 4), and a third mode (shown in FIG. 5). The hydraulic system may be moved between the first mode, the second mode, and the third mode by a control system (e.g., the control system 50 described in FIG. 1).

Referring to FIG. 3, when the hydraulic system is in the first mode, the winch assembly 40 is active such that the winch spool 41 is rotating in a first direction. In this position, the hydraulic fluid is pumped from the hydraulic reservoir 202 such that the hydraulic fluid moves along a first path of travel 201 to the cooling system 204. In the illustrated embodiment, the first valve 208 is in an open position and the hydraulic fluid is pumped through the first valve 208 and into the winch assembly 40 to power the winch assembly 40 such that the winch spool 41 rotates in the first direction. The temperature of the hydraulic fluid increases as the hydraulic fluid powers the winch assembly 40. In some embodiments, at least a portion of the heated hydraulic fluid may move along a return path of travel 313 in which the heated hydraulic fluid moves back through the first valve 208 and into the hydraulic reservoir 202. In some embodiments, the return path of travel 313 does not include movement of hydraulic fluid back through the first valve 208, but may include movement of the hydraulic fluid through one or more additional valves (not shown). The remaining heated hydraulic fluid may then continue to move along the path of travel 201 such that the heated hydraulic fluid moves through the cooling system 204 to decrease the temperature of the hydraulic fluid prior to returning to the hydraulic reservoir 202. The cooling system 204 is configured to prevent the hydraulic system 200 from overheating. In some embodiments, the heated hydraulic fluid moves through one or more pressure control valves 312 prior to moving through the cooling system 204. When the hydraulic system 300 is in the first mode, the second valve 210 is closed such that the hydraulic fluid is prevented from moving along a second path of travel 203 to the cooling system 204.

Referring to FIG. 4, when the hydraulic system is in the second mode, the winch assembly 40 is active such that the winch spool 41 is rotating in a second direction that is opposite the first direction (as described with regards to FIG. 3). In this mode, the hydraulic fluid is pumped from the hydraulic reservoir 202 such that the hydraulic fluid moves along a first path of travel 201 to the cooling system 204. In the illustrated embodiment, the first valve 208 is in an open position and the hydraulic fluid is pumped through the first valve 208 and into the winch assembly 40 to power the winch assembly 40 such that the winch spool 41 rotates in the second direction. The temperature of the hydraulic fluid increases as the hydraulic fluid powers the winch assembly 40. In some embodiments, at least a portion of the heated hydraulic fluid may move along a return path of travel 313 in which the heated hydraulic fluid moves back through the first valve 208 and into the hydraulic reservoir 202. In some embodiments, the return path of travel 313 does not include movement of hydraulic fluid back through the first valve 208, but may include movement of the hydraulic fluid through one or more additional valves (not shown). The remaining heated hydraulic fluid may then continue to move along the path of travel 201 such that the heated hydraulic fluid moves through the cooling system 204 to decrease the temperature of the hydraulic fluid prior to returning to the hydraulic reservoir 202. The cooling system 204 is configured to prevent the hydraulic system 200 from overheating. In some embodiments, the heated hydraulic fluid moves through one or more pressure control valves 312 prior to moving through the cooling system 204. When the hydraulic system 300 is in the second mode, the second valve 210 is closed such that the hydraulic fluid is prevented from moving along a second path of travel 203 to the cooling system 204.

Referring to FIG. 5, when the hydraulic system is in the third mode, the winch assembly 40 is idle. In this position, the hydraulic fluid is pumped from the hydraulic reservoir 202 such that the hydraulic fluid moves along the second path of travel 203 to the cooling system 204. In the illustrated embodiment, the second valve 210 is in an open position and the hydraulic fluid is pumped through the second valve 210 and the cooling system 204 prior to returning back to the hydraulic reservoir 202. The cooling system 204 is configured to decrease the temperature of the hydraulic fluid, which prevents the hydraulic system 200 from overheating, as well as helps an overheated hydraulic system to recover to a non-overheated condition. In some embodiments, the hydraulic fluid moves through one or more pressure control valves 312 prior to moving through the cooling system 204. When the hydraulic system 300 is in the third mode, the first valve 208 is closed such that the hydraulic fluid is prevented from moving to the winch assembly 40.

INDUSTRIAL APPLICABILITY

Hydraulic systems for work machines that include a hydraulic winch can overheat quickly. For example, after hydraulic fluid powers the winch, the hydraulic fluid returns to a hydraulic reservoir, and this return hydraulic fluid is typically the hottest hydraulic fluid in the system, which can cause the hydraulic system to overheat. Once the hydraulic system overheats, the work machine may need to be idled until the hydraulic system recovers, which causes a delay in the construction for which the work machine is being used. While a cooling system can be disposed downstream of the hydraulic winch to cool down the return hydraulic fluid that is moving back into the hydraulic reservoir such that the overheating of the hydraulic system is delayed, this placement of the cooling system alone does not solve the problem of the amount of time it takes for a hydraulic system to recover after overheating.

Referring to FIG. 2, the hydraulic system 200 is configured to both prevent overheating of the hydraulic system and decrease the amount of recovery time after the hydraulic system overheats. For example, the hydraulic system 200 has a first path of travel 201 between a pump 206 and a cooling system 204 and a second path of travel 203 between the pump 206 and the cooling system 204. The winch assembly 40 is disposed along the first path of travel 201 such that hydraulic fluid can be provided to the winch assembly 40 to power the winch assembly 40.

When the winch assembly 40 is active, a pump 206 pumps hydraulic fluid from a hydraulic reservoir 202 and along the first path of travel 201 such that the hydraulic fluid powers the winch assembly 40. The hydraulic fluid that exits the winch assembly 40 is typically the hottest hydraulic fluid in the system 200, and this heated hydraulic fluid then moves through a cooling system 204, which prevents the hydraulic system 200 from overheating.

When the winch assembly 40 is idle, the pump 206 pumps hydraulic fluid from hydraulic reservoir 202 and along the second path of travel 203 such that the hydraulic fluid moves through the cooling system 204 and then returns to the hydraulic reservoir. This movement of the hydraulic fluid along the second path of travel prevents the hydraulic system from becoming overheated and decreases the recovery time of the hydraulic system if it does become overheated. That is, cooling the hydraulic fluid that is being stored in the hydraulic reservoir 202 will cause the hydraulic fluid to cool down when the winch assembly 40 is idle, which will cause the hydraulic fluid to reach a non-overheated temperature in a reduced amount of time.

While various inventive aspects, concepts and features of the inventions may be described and illustrated herein as embodied in combination with exemplary embodiments, these various aspects, concepts and features may be used in many alternative embodiments, either individually or in various combinations and sub-combinations thereof. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein.

Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

LIST OF ELEMENTS

| Element Number | Element Name |
|---|---|
| 11 | work machine |
| 15 | work implement |
| 16 | frame |
| 17 | engine |
| 18 | sprocket |
| 19 | ground-engaging mechanism |
| 20 | drivetrain |
| 21 | arms |
| 22 | first hydraulic cylinder |
| 23 | second hydraulic cylinder |
| 24 | cab |
| 40 | winch assembly |
| 41 | winch spool |
| 50 | control system |
| 51 | controller |
| 52 | winch control system |
| 200 | hydraulic system |
| 201 | path of travel |
| 202 | hydraulic reservoir |
| 203 | path of travel |
| 204 | cooling system |
| 205 | radiator and fan assembly |

-continued

LIST OF ELEMENTS

| Element Number | Element Name |
|---|---|
| 206 | pump |
| 208 | first valve |
| 210 | second valve |
| 300 | hydraulic system |
| 312 | pressure control valve(s) |
| 313 | return path of travel |

What is claimed is:

1. A hydraulic system for powering a winch assembly of a work machine, the hydraulic system comprising:

a hydraulic reservoir for holding hydraulic fluid;

a pump for pumping the hydraulic fluid from the hydraulic reservoir;

a cooling system configured to decrease a temperature of the hydraulic fluid as it moves through the cooling system, wherein the cooling system is disposed between the pump and the hydraulic reservoir;

a first path of travel disposed between the pump and the hydraulic reservoir, wherein the winch assembly is powered by the hydraulic fluid moving along the first path of travel;

a first valve in fluid communication with the pump and disposed along the first path of travel, the first valve being movable between an open position and a closed position;

a second path of travel disposed between the pump and the reservoir;

a second valve in fluid communication with the pump and disposed along the second path of travel, the second valve being movable between an open position and a closed position; and a return path of travel extending between the winch assembly and the reservoir;

wherein, when the winch assembly is in an active condition, the first valve is in the open position to allow the hydraulic fluid to move along the first path of travel and the second valve is in the closed position to prevent the hydraulic fluid from moving along the second path of travel, wherein the hydraulic fluid moves along the first path of travel to power the winch assembly and move through the cooling system to cool the hydraulic fluid that was heated by the winch assembly; and wherein, when the winch assembly is in an idle condition, the first valve is in the closed position to prevent the hydraulic fluid from moving along the first path of travel and the second valve is in the open position to allow the hydraulic fluid to move along the second path of travel, wherein the hydraulic fluid moving through the second valve and along the second path of travel moves through the cooling system to cool hydraulic fluid from the hydraulic reservoir;

wherein at least a portion of the hydraulic fluid that powered the winch assembly moves along the return path of travel such that the portion of the hydraulic fluid bypasses the cooling system and moves back through the first valve and into the hydraulic reservoir.

2. The hydraulic system according to claim 1, wherein the hydraulic fluid is oil.

3. The hydraulic system according to claim 1, wherein the work machine is a track-type tractor.

4. The hydraulic system according to claim 1, further comprising a control system that operates the winch assembly to cause the winch assembly to be in one of the active condition and the idle condition.

5. The hydraulic system according to claim 1, further comprising one or more pressure control valves for controlling a pressure of the hydraulic fluid that moves through the cooling system.

6. The hydraulic system according to claim 1, wherein the cooling system comprises a radiator and fan assembly.

7. The hydraulic system according to claim 1, wherein the hydraulic system is movable between a first mode in which the winch assembly is in the active condition and a winch spool of the winch assembly is rotating in a first direction, a second mode in which the winch assembly is in the active condition and the winch spool is rotating in a second direction that is opposite the first direction, and a third mode in which the winch assembly is in the idle condition.

8. A work machine, comprising:

a frame;

a ground-engaging mechanism connected to the frame;

a drivetrain for driving the ground-engaging mechanism;

a winch assembly that is movable between an active condition and an idle condition;

a hydraulic system configured to power the winch assembly when the winch assembly is in the active condition, the hydraulic system comprising:

a hydraulic reservoir for holding hydraulic fluid;

a pump for pumping the hydraulic fluid from the hydraulic reservoir;

a cooling system configured to decrease a temperature of the hydraulic fluid as it moves through the cooling system, wherein the cooling system is disposed between the pump and the hydraulic reservoir;

a first path of travel disposed between the pump and the hydraulic reservoir, wherein the winch assembly is powered by the hydraulic fluid moving along the first path of travel;

a first valve in fluid communication with the pump and disposed along the first path of travel, the first valve being movable between an open position and a closed position;

a second path of travel disposed between the pump and the reservoir;

a second valve in fluid communication with the pump and disposed along the second path of travel, the second valve being movable between an open position and a closed position; and a return path of travel extending between the winch assembly and the reservoir;

wherein, when the winch assembly is in the active condition, the first valve is in the open position to allow the hydraulic fluid to move along the first path of travel and the second valve is in the closed position to prevent the hydraulic fluid from moving along the second path of travel, wherein the hydraulic fluid moves along the first path of travel to power the winch assembly and moves through the cooling system to cool the hydraulic fluid that was heated by the winch assembly; and wherein, when the winch assembly is in the idle condition, the first valve is in the closed position to prevent the hydraulic fluid from moving along the first path of travel and the second valve is in the open position to allow the hydraulic fluid to move along the second path of travel, wherein the hydraulic fluid moving through the second valve and along the second path of travel moves through the cooling system to cool the hydraulic fluid from the hydraulic reservoir;

wherein at least a portion of the hydraulic fluid that powered the winch assembly moves along the return path of travel such that the portion of the hydraulic fluid bypasses the cooling system and moves back through the first valve and into the hydraulic reservoir.

9. The work machine according to claim 8, wherein the hydraulic fluid is oil.

10. The work machine according to claim 8, wherein the work machine is a track-type tractor.

11. The work machine according to claim 8, further comprising a control system that operates the winch assembly to cause the winch assembly to be in one of the active condition and the idle condition.

12. The work machine according to claim 8, wherein the hydraulic system comprises one or more pressure control valves for controlling a pressure of the hydraulic fluid that moves through the cooling system.

13. The work machine according to claim 8, wherein the cooling system comprises a radiator and fan assembly.

14. The work machine according to claim 8, wherein the hydraulic system is movable between a first mode in which the winch assembly is in the active condition and a winch spool of the winch assembly is rotating in a first direction, a second mode in which the winch assembly is in the active condition and the winch spool is rotating in a second direction that is opposite the first direction, and a third mode in which the winch assembly is in the idle condition.

15. A method of cooling hydraulic fluid of a hydraulic system for a winch assembly of a work machine, the method comprising:

moving the hydraulic fluid from a hydraulic reservoir along a first path of travel when the winch assembly is in an active condition such that the hydraulic fluid moves through a first valve, through the winch assembly, through a cooling system, and returns to the hydraulic reservoir;

moving at least a portion of the hydraulic fluid that moved through the winch assembly along a return path of travel such that the portion of the hydraulic fluid bypasses the cooling system and moves back through the first valve and into the hydraulic reservoir;

moving the hydraulic fluid from the hydraulic reservoir along a second path of travel when the winch assembly is in an idle condition such that the hydraulic fluid moving along the second path of travel moves through a second valve, through the cooling system, and returns to the hydraulic reservoir.

16. The method according to claim 15, wherein the hydraulic fluid is prevented from moving along the second path of travel when the winch assembly is in the active condition, and wherein the hydraulic fluid is prevented from moving along the first path of travel when the hydraulic fluid is in the idle condition.

17. The method according to claim 15, wherein the hydraulic fluid is moved along the first path of travel and the second path of travel by a pump.

18. The method according to claim 17, wherein a control system operates the pump to move the hydraulic fluid along one of the first path of travel and the second path of travel.

* * * * *